US006924724B2

(12) United States Patent
Grilo et al.

(10) Patent No.: US 6,924,724 B2
(45) Date of Patent: Aug. 2, 2005

(54) METHOD AND APPARATUS FOR TRANSFORMER BANDWIDTH ENHANCEMENT

(75) Inventors: Jorge Alberto Grilo, Mission Viejo, CA (US); Larance B. Cohen, Irvine, CA (US)

(73) Assignee: Solarflare Communications, Inc., Irvine, CA (US)

( * ) Notice: Subject to any disclaimer, the term of this patent is extended or adjusted under 35 U.S.C. 154(b) by 184 days.

(21) Appl. No.: 10/350,597

(22) Filed: Jan. 24, 2003

(65) Prior Publication Data

US 2004/0145439 A1 Jul. 29, 2004

(51) Int. Cl.[7] ..... H01F 21/02

(52) U.S. Cl. ..... 336/145; 336/212; 336/160; 336/181; 324/127; 324/253; 324/118; 361/232; 361/235

(58) Field of Search ..... 336/145, 212, 336/185, 198; 363/68, 53; 324/127, 253, 118; 361/232, 235, 270

(56) References Cited

U.S. PATENT DOCUMENTS 5,579,202 A * 11/1996 Tolfsen et al. ..... 361/232

OTHER PUBLICATIONS

"Producing a Counter EMF", pp. 1–3, http://www.tpub.com/neets/book2/5e.htm , pp. 1–3, (date unknown).

"Electric Machinery, Chap. 2 Transformers –Dot Convention to Denote the Polarity of a Transformer", p. 2A–9, (Sep. 18, 1995).

"Transformer Polarity", Copyright 2002 Kilowatt Classroom, LLC, sheet 1.

"Use of Ferrites in Broadband Transformers", Fair–Rite Products Corp., 14th Edition, p. 170–173 (date unknown).

"Design of H.F. Wideband Power Transformers; Part II, EC07213", Philips Semiconductors, Mar. 23, 1998, pp. 1–10.

* cited by examiner

*Primary Examiner*—Lincoln Donovan
*Assistant Examiner*—Jennifer A. Poker
(74) *Attorney, Agent, or Firm*—Weide & Miller, Ltd.

(57) ABSTRACT

A method and apparatus for transformer bandwidth enhancement is disclosed. In one embodiment, a transformer is provided for use in a high frequency communication environment. In one configuration, the transformer is configured with one or more compensation networks to improve high frequency operation and to reduce insertion loss at all frequencies. The compensation networks may be designed, in combination with a transformer, to create an equivalent all-pass symmetric lattice network having a frequency response in the desired range. In one embodiment, the compensation networks comprise a capacitance creating device which, when cross-connected to the transformer, increases transformer bandwidth.

11 Claims, 10 Drawing Sheets

Effect of Lowpass Compensation on Transformer Frequency Response

METHOD AND APPARATUS FOR TRANSFORMER BANDWIDTH ENHANCEMENT

FIELD OF THE INVENTION

The invention relates to communication transformers and, in particular, to a method and apparatus for increasing a transformer's high frequency performance.

RELATED ART

High-speed data communication systems, such as for example, 1000BaseT systems, often require a line transformer between the transceiver and the physical medium. The transformer provides DC isolation, impedance transformation, common-mode signal suppression, and a safety insulation barrier to meet regulatory safety requirements. To prevent degradation of system performance, it is preferable that the transformer display low insertion loss, thereby maximizing transmit power, and a high return loss, to minimize channel echo effects across a transmit signal's bandwidth.

In systems of the prior art, these requirements are often extremely difficult to meet at signal frequencies above approximately 200 MHz. This difficulty limits the use of transformers to low or moderate data-rate applications, or limits transmittal speeds. While these limitations have previously existed, prior transmit speeds did not approach the physical limitations of prior art transformer capabilities. More recently however, new data communications standards are being proposed, such as for example, 10GBase-T, which may require signal bandwidths in the order of 300 MHz or more. As a result, prior art transformer designs are unacceptable for high frequency applications.

Generally speaking, the useful bandwidth of a transformer is the frequency range where the insertion loss is below a prescribed limit and the return loss is above a prescribed limit. In the past, there have been two primary proposed solutions to extend the usable bandwidth of transformers. Both of these proposed solutions, however, have drawbacks that make both them unsuitable for higher frequency data communications applications.

FIG. 1A shows a transformer with a prior art configuration for increasing frequency bandwidth. An exemplary transformer 104 may comprise any type prior art transformer and is shown having a primary side terminals 108A, 108B and secondary side terminals 120A, 120B. One prior art compensation method comprises connecting a capacitor 112 between terminal 108A and terminal 108B. Likewise, a compensation capacitor 124 connects between terminal 120A and 120B. In this configuration, the capacitors 112, 124 act as the compensation capacitors to increase the bandwidth of the transformer. These capacitors 112, 124, when combined with the transformer series leakage inductance, create an equivalent second order (one added capacitor across one winding) or third-order (added capacitors across both windings) lowpass filter network. The added external capacitors 112,124 introduce peaking into the upper region of the passband, thereby extending the useful bandwidth of the transformer. Note that the −3 dB bandwidth of the transformer 104 does not change, and still depends, to a first order, on the value of the leakage inductance. This effect is illustrated in FIG. 1B.

As a numerical example, a 1:1 turns ratio transformer with termination resistances of 100 Ohms and an effective leakage inductance (lumping together the primary leakage, secondary leakage, and package parasitic inductance) of 100 nH, has a 3-dB corner frequency of 318 MHz and a 1.0 dB bandwidth of about 160 MHz. Note that the amount of bandwidth improvement depends upon the selectivity and order of the lowpass function synthesis and the maximum loss limit specified for useful bandwidth. There is no obvious correlation between selectivity and improvement. This compensation method is ultimately limited by the value of the transformer leakage inductance.

Another proposed solution is to avoid the aforementioned problems by utilizing a transmission line transformer in high frequency environments. Since the transmission line transformer does not operate on the principle of magnetic flux coupling, it is not subject to the same limiting parasitic effects, and thus has an inherently wider signal bandwidth. Transmission line transformers are generally used in RF applications providing impedance matching between transmission lines, antennas, and RF amplifier output stages. The transmission line transformer, however, does not provide high-voltage DC isolation, has poor low-frequency common-mode rejection, and is restricted to a small set of feasible turn ratios, as determined by multifilar construction. Moreover, the characteristic impedance of the windings (across each conductor pair) must be reasonably well controlled for proper operation. Most data communication line transformers require high-voltage DC isolation for safety compliance, good low-frequency common-mode rejection for immunity from noise interference, and often use non-integer turns ratios (e.g. 50 Ohms to 100 Ohms). As a result, transmission line transformers are not ideally suited for most data communication applications.

Accordingly, there is a need in the art for a transformer which is capable of reliable operation at high or low frequencies and which meet required safety standards and standards requirements in areas such as high-voltage DC isolation, and low-frequency common-mode rejection requirements. The method and apparatus described below overcomes the drawbacks of the prior art.

SUMMARY

The method and apparatus described herein extends the frequency range of transformers thereby allowing high frequency signals to pass through transformers. One example environment of the method and apparatus described herein is in high frequency communication devices. It is contemplated that the principles disclosed herein may be utilized in any device and for use at any frequency, if so designed.

In one example embodiment, a system for increasing the bandwidth of a transformer is disclosed wherein the transformer has a primary winding with a first primary winding terminal and a second primary winding terminal. The transformer also has a secondary winding with a first secondary winding terminal and a second secondary winding terminal. In this embodiment, the system comprises a first capacitor connected between the first primary winding terminal and the second secondary winding terminal. A second capacitor is connected between the second primary winding terminal and the first secondary winding terminal. These capacitors may be considered compensation capacitors. In this embodiment, the first primary winding terminal is of a different polarity than the second secondary winding terminal and the capacitance of the first capacitor and second capacitor are selected to increase the bandwidth of the transformer.

In one embodiment, the transformer is in a balanced configuration. It is also contemplated that either or both of the first capacitor and the second capacitor comprise capacitors selected from the group of capacitors consisting of printed circuit board capacitors, thick-film hybrid capacitors, or thin-film hybrid capacitors. In addition, the first and second terminals of the primary winding may connect to a communication device and the first and second terminals of the secondary winding may connect to a communication channel. In such an embodiment, the bandwidth of the transformer may be made to be greater than 200 MHz.

In another embodiment, a high frequency transformer system is provided and comprises a first winding, defined by a first conductor having a first end and a second end, and a second winding proximately arranged to the first winding. The second winding may be defined by a second conductor having a third end and a fourth end. To increase the bandwidth, a first compensation device may be connected, such as cross-connected between the first winding and the second winding. In addition, a second compensation device may be cross-connected between the first winding and the second winding such that the first compensation device and the second compensation device are connected to different ends of the windings.

It is contemplated that the first compensation device and the second compensation device may comprise capacitors. The term proximately arranged may be defined to mean sufficiently close to establish magnetic and electric field coupling. The term cross-connected may be defined to mean connected between ends of a transformer that are of different polarity. Such an embodiment may also comprise one or more inductive devices connected to one or more ends such that they are configured to tune the transformer to one or more frequency bandwidths. In one configuration, a high frequency transformer configured in this manner may have a bandwidth of between 200 MHz and 450 MHz.

Also disclosed herein is a method for increasing the bandwidth of a transformer. In one embodiment, the first step may comprise providing a transformer having a first winding and a second winding. The next step may comprise cross-connecting a first capacitance between the first winding and the second winding and cross-connecting a second capacitance between the first winding and the second winding. This method compensates for, among other things, the leakage inductance of the windings. In one embodiment, the method allows the transformer to be used in a multi-gigabit-rate communication system. In one embodiment, the first capacitance and the second capacitance may be generated by printed circuit board traces or generated by external capacitors. For example, the cross-connection of the first capacitance and the second capacitance may create a symmetrical lattice all-pass network. In one example implementation, the first capacitance maybe between 1 and 10 pico-farads and the second capacitance may be between 1 and 10 pico-farads. In other embodiments, any capacitance value may be utilized.

In another method for increasing the bandwidth of a transformer, a transformer having a primary side and a secondary side is provided such that each of the sides has two or more terminals and each terminal is associated with either of a first polarity or a second polarity. With such a transformer, the bandwidth may be increased, i.e. operation at higher frequencies may be enabled by connecting a capacitance between a terminal of the primary side having a first polarity and a terminal of the secondary side having a second polarity. In addition, a capacitance is connected between a terminal of the primary side having a second polarity and a terminal of the secondary side having a first polarity. Thus, a compensation network is established.

In a variation of this embodiment, the secondary side is configured to connect to a cable selected from the group of cables consisting of category 5 UTP cable, category 5e, category 6, and class D, E, F cables. It is contemplated that the first polarity may comprise a positive polarity and the second polarity may comprise a negative polarity. In one embodiment, this method is utilized to enable operation of the transformer at frequencies greater than 150 MHz. In addition, the transformer may also provide DC isolation of greater than 1000 Volts between the primary side and the secondary side. It is contemplated that the primary side may comprise a primary winding and the secondary side may comprises a secondary winding and the primary winding and the secondary winding may achieve magnetic flux coupling.

Yet another method for increasing the bandwidth of a communication device transformer that has a primary winding and a secondary winding is disclosed herein. This method comprises cross-connecting one or more compensation networks to the transformer to establish an all-pass network. The one or more compensation networks may comprise one or more printed circuit board capacitor traces. In addition, the transformer may be in a reverse polarity configuration, thereby eliminating crossed conductors when cross-connecting the one or more compensation networks. In one embodiment, the transformer is in an unbalanced-to-unbalanced coupled configuration.

Working from these principles, a method for transmitting a signal from a communication device is also disclosed. This method comprises receiving a signal at a first set of terminals and providing the signal to a first winding. The first winding may be configured to generate a field capable of inducing a signal in a second winding. The method may also generate a mirrored signal in the second winding as a result of generating the field in the first winding. However, the first winding and the second winding suffer from flux leakage, and consequently, the signal is also provided to a compensation system to compensate for the flux leakage. In one embodiment, flux leakage creates a series equivalent inductance and the compensation system introduces a capacitance to cancel the series equivalent inductance. It is contemplated that the first winding and the second winding may be configured to pass differential signals, reject common mode signals, and provide DC isolation between the first set of terminals and the second set of terminals. For example, the second set of terminals may connect to a communication channel.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE DRAWINGS

The components in the figures are not necessarily to scale, emphasis instead being placed upon illustrating the principles of the invention. In the figures, like reference numerals designate corresponding parts throughout the different views.

DETAILED DESCRIPTION

In general, high-frequency performance limitations in magnetically coupled line transformers are due to parasitic components associated with imperfections in transformer construction. Typical limiting factors are the transformer core—material, geometry, etc., winding construction—winding method, turns ratio, etc., and package construction. As way of introduction to the invention, a typical high frequency transformer circuit model is shown in FIG. 2.

Figure 2:
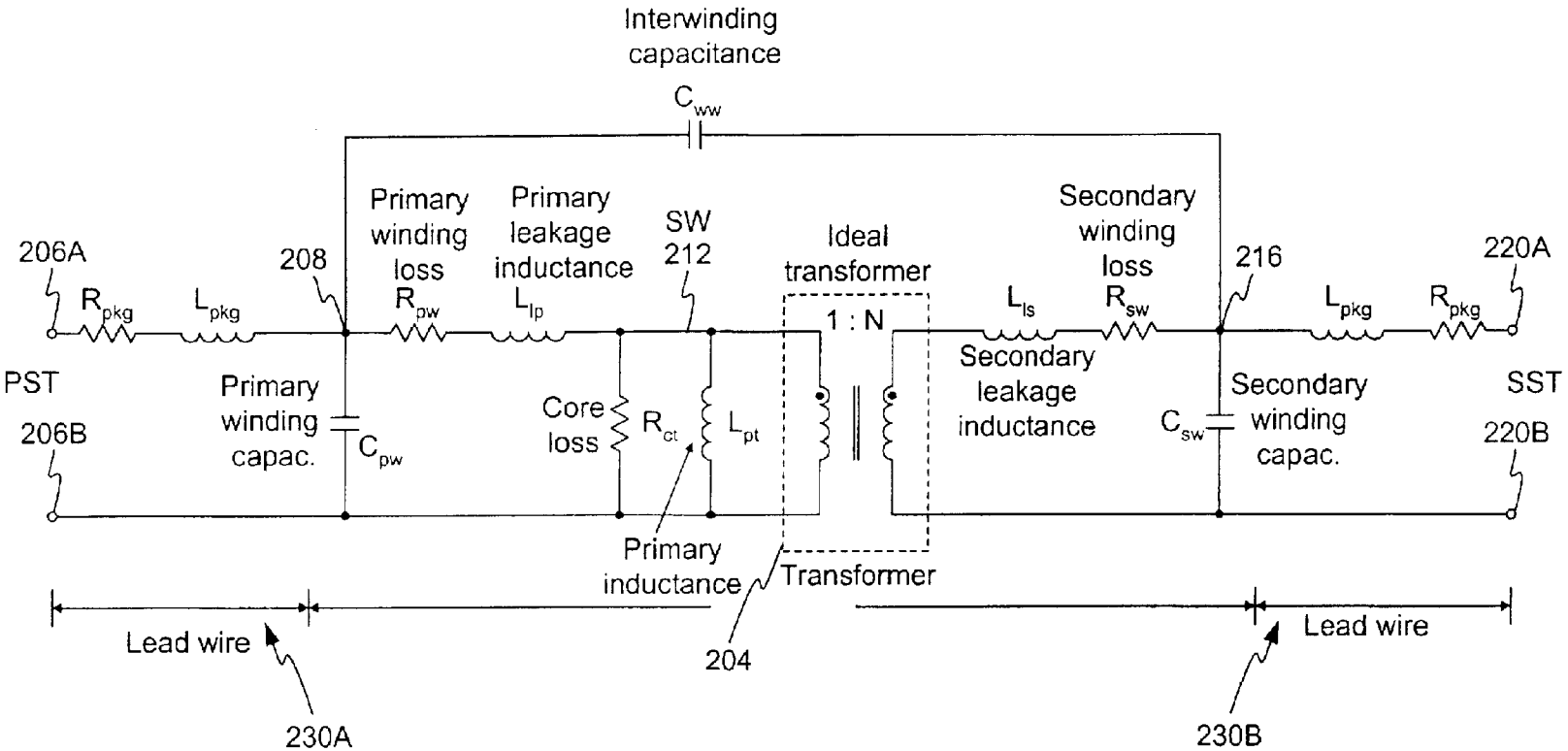
FIG. 2 illustrates an example diagram of a high frequency transformer circuit model.

As shown in FIG. 2, an ideal transformer 204 is shown having a turn ratio of 1:N, where N equals any numeric value. As can be understood, an ideal transformer does not exist, as all transformers have associated parasitic resistances, inductances, and capacitances. Accordingly, FIG. 2 also illustrates the equivalent parasitic resistances, inductances, and capacitances that may be modeled or associated with an actual transformer. Working from the left hand side of the figure, primary side terminals, (PST), 206A, 206B allow for connection to the transformer. The primary side terminal 206A sees a series combination of resistance $R_{pkg}$ and inductance $L_{pkg}$, which in turn connects to a first node 208. The resistance $R_{pkg}$ and inductance $L_{pkg}$ represent the package lead wire impedance. Also modeled as being connected between the first node 208 and the terminal 206B is a primary winding self capacitance $C_{pw}$. Also connected to the first node 208 and a second node 212 is a series connected primary winding loss $R_{pw}$ and a primary leakage inductance $L_{lp}$. The primary winding loss $R_{pw}$ represents resistive losses within the winding conductor. The primary leakage inductance $L_{lp}$ represents the equivalent series inductance created by the small fraction of magnetic flux not coupled (i.e. leaked) to the secondary winding. The core resistance $R_{ct}$ represents absorption losses within the core material. Primary inductance $L_{pt}$ represents the transformer magnetizing inductance. The second node 212 and the primary terminal 206B connect to the ideal transformer model 204 as shown.

An interwinding capacitance $C_{ww}$ is shown between the first node 208 and a third node 216. The interwinding capacitance $C_{ww}$ represents the mutual coupling capacitance between the primary and secondary windings.

Turning to the right hand side of FIG. 2, a secondary side terminal 220A, 220B provides for connection to the secondary side of the transformer. The terminal 220A connects to a series connection of resistance $R_{pkg}$ and inductance $L_{pkg}$ with the third node 216. As discussed above, the resistance $R_{pkg}$ and inductance $L_{pkg}$ represent the package lead wire impedance. A secondary winding capacitance $C_{sw}$, which represents the secondary winding self capacitance, is shown between the third node 216 and the secondary side terminal 220B. A series connected secondary winding loss $R_{sw}$ and secondary leakage inductance $L_{ls}$ is modeled between the secondary side of the ideal transformer 204 and the third node 216.

The lead lines 230A, 230B should be considered to be the package lead wires to the transformer. Although not part of the internal aspects of the transformer, the properties of the lead lines 230A, 230B may affect transformer operation.

A discussion of basic transformer properties is now provided with emphasis on discoveries by the inventors as related to transformer bandwidth enhancement. Core construction of a transformer affects transformer performance through the material properties and through the core geometry. Two material properties that affect transformer performance are bulk permeability and resistivity.

The permeability of a magnetic material is the ratio of magnetic flux density generated within the material to the external magnetization, and is analogous to electrical conductance. Increasing the material permeability allows greater inductance with fewer windings. For certain core shapes, specifically cores with an air gap, a higher permeability improves the core's ability to contain magnetic flux created by the windings, thus reducing the so-called leakage inductance (magnetic flux lines not captured by the coupled windings). Unfortunately, all magnetic materials lose permeability as the operating frequency increases, effectively causing the core to "disappear." To ensure adequate high frequency performance, the core geometry may be selected to contain the magnetic flux, even at frequencies where core permeability is low. Toroidal shapes are effective at containing flux, and hence toroidal cores may be used for high frequency applications.

Another way the core material affects transformer performance is through eddy current core loss. (Eddy currents are electrical current loops induced around magnetic flux lines within the core material.) These internal core currents are dissipated within the core through resistive losses. Eddy current core losses depend upon the bulk resistivity of the material and are electrically equivalent to placing a shunt resistance across a transformer winding ("$R_{ct}$" in FIG. 2). For common ferrite materials, increasing bulk resistivity decreases core loss but also decreases permeability. Core loss noticeably affects transformer insertion loss, but it is not the most significant band-limiting mechanism.

Leakage inductance ("$L_{lp}$" and "$L_{ls}$" in FIG. 2) is the equivalent series inductance introduced by imperfect magnetic flux linkage between transformer windings and is solely a function of winding construction. It has been determined that the leakage inductance combines with the termination impedance to produce a first-order low-pass network that ultimately sets the transformer bandwidth. At very high frequencies, the leakage inductance may form a parallel resonance with the interwinding capacitance ("$C_{ww}$" in FIG. 2), thereby introducing a deep notch in the overall transfer function. As a result, increasing the leakage inductance reduces the transformer bandwidth, increases pass-band insertion loss, and reduces pass-band return loss.

The winding method most commonly used to reduce leakage inductance is multifilar winding. In a multifilar winding, the individual winding conductors are twisted together and then wound around the core as a single strand. The close physical proximity between each winding conductor increases magnetic flux coupling, thus reducing leakage inductance (at the expense of increased interwinding capacitance).

The turn ratio ("N" in FIG. 2) also indirectly affects leakage inductance. Moreover, certain turn ratios require a minimum number of total turns to ensure sufficient accuracy. For example, a 1.4 turn ratio requires five (5) primary turns and seven (7) secondary turns, but a 1.5 turn ratio requires two (2) primary turns and three (3) secondary turns. Increasing the number of windings on both primary and secondary improves the impedance matching accuracy, but has been found to increase leakage inductance, therefore reducing the bandwidth. Because of the short lengths of winding wire used in high-frequency signal applications, winding resistance losses have observable but minimal effect compared to the leakage inductance.

Finally, package parasitics introduce additional degradation. Packaging affects performance mostly in applications with signal bandwidths greater than 100 MHz. The dominant component is the inductance from the lead wires 230A, 230B between the package pin (or pad) and the transformer core. Due to series inductance, lead lengths greater than 3 mm may result in additional and significant insertion loss.

Figure 3:
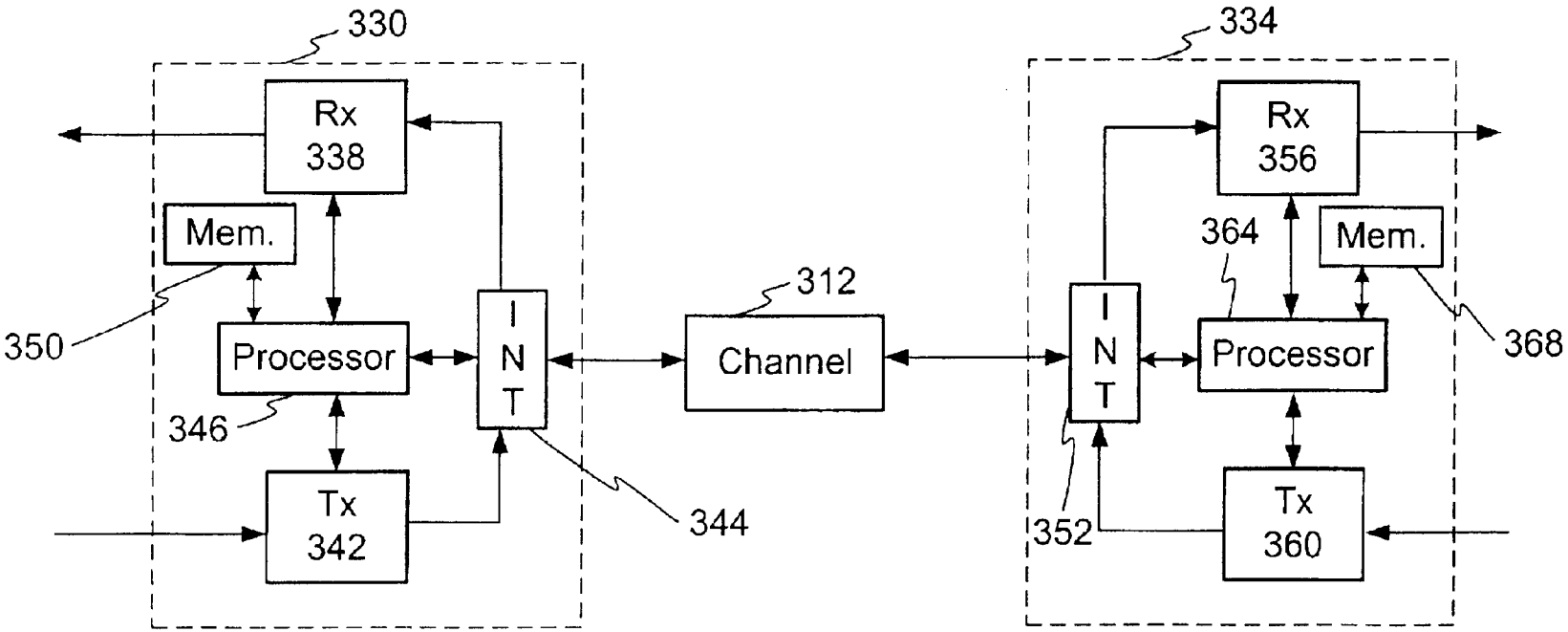
FIG. 3 illustrates an example environment for use of the invention described herein.

FIG. 3 illustrates a block diagram of an example environment for use of the invention described herein. In reference to FIG. 3, a block diagram of a receiver/transmitter pair is shown. A channel 312 connects a first transceiver 330 to a second transceiver 334. The first transceiver 330 connects to the channel 312 via an interface 344. The interface 344 is configured to isolate incoming from outgoing signals and may provide DC isolation. The interface may comprise a transformer configured according to the principles described herein. In one embodiment, the DC isolation is at least 1500 Volts. In another embodiment, the DC isolation at least 1000 Volts. In yet another embodiment, the DC isolation is at least 2000 Volts. In another embodiment, the channel 312 may comprise numerous conductors, and hence, the interface 344 may perform isolation or separation of signals on the numerous conductors based on direction of data flow or based on connection to either of a receiver module 338 or a transmitter module 342. The receiver module 338 and transmit module 342 may comprise any assembly of hardware, software, or both configured to operate in accordance with the principles described herein or with any communication system or standard.

The receiver module 338 and transmit module 342 communicate with a processor 346. The processor 346 may include or communicate with memory 350. The memory 350 may comprise one or more of the following types of memory: RAM, ROM, hard disk drive, flash memory, or EPROM or any other type of memory or register. The processor 346 may be configured to perform one or more calculations or any type of signal analysis. In one embodiment, the processor 346 is configured to execute machine readable code stored on the memory 350. The processor 346 may perform additional signal processing tasks as described below.

The second transceiver 334 is configured similarly to the first transceiver 330. The second transceiver 334 comprises an interface 352 connected to a receiver module 356 and a transmitter module 360. The receiver module 356 and a transmitter module 360 communicate with a processor 364, which in turn connects to a memory 368.

The transformer configurations and associated circuitry shown and described herein may be located within the interfaces 344, 352 or at another location in the channel 312 or transceivers 330, 334. The transformer configurations and associated circuitry provide isolation between the one or more transmission lines or conductors and the other aspects of the transceivers 330, 334.

Figure 4:
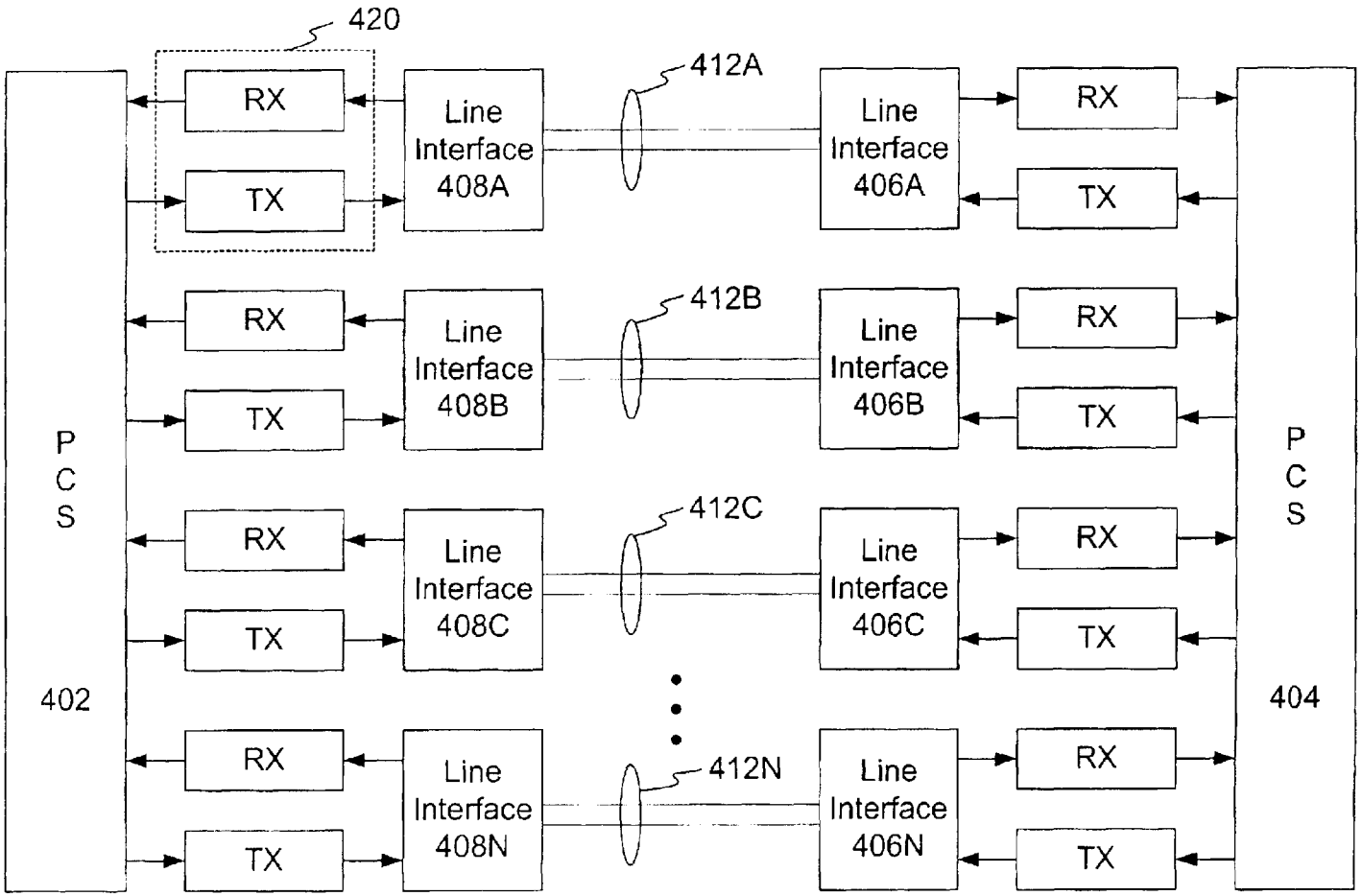
FIG. 4 illustrates another possible example environment of the invention described herein.

FIG. 4 illustrates yet another possible example environment of the invention described herein. It should be noted that these example environments should not be considered to be the only type systems that will benefit from the principles disclosed and claimed herein. It is contemplated that any numerous high, low, or mid-frequency applications will benefit from the teachings of this patent. The communication system illustrated in FIG. 4 is configured as an exemplary multi-channel point-to-point communication system. One exemplary application is a 10 gigabit transceiver utilizing a Category 5 UTP cable supporting Ethernet protocols. As shown, it includes a physical coding sublayer 402 and 404, shown as coupled over a channel 412. In one embodiment, each channel comprises twisted pair conductors. Each of the channels 412 is coupled between transceiver blocks 420 through a line interface 408 and 406. Each channel is configured to communicate information between transmitter/receiver circuits (transceivers) and the physical coding sublayer (PCS) blocks 402, 404. Any number of channels and associated circuitry may be provided. In one embodiment, the transceivers 420 are capable of full-duplex bi-directional operation. In one embodiment, the transceivers 420 operate at an effective rate of about 2.5 Gigabits per second.

Figure 5:
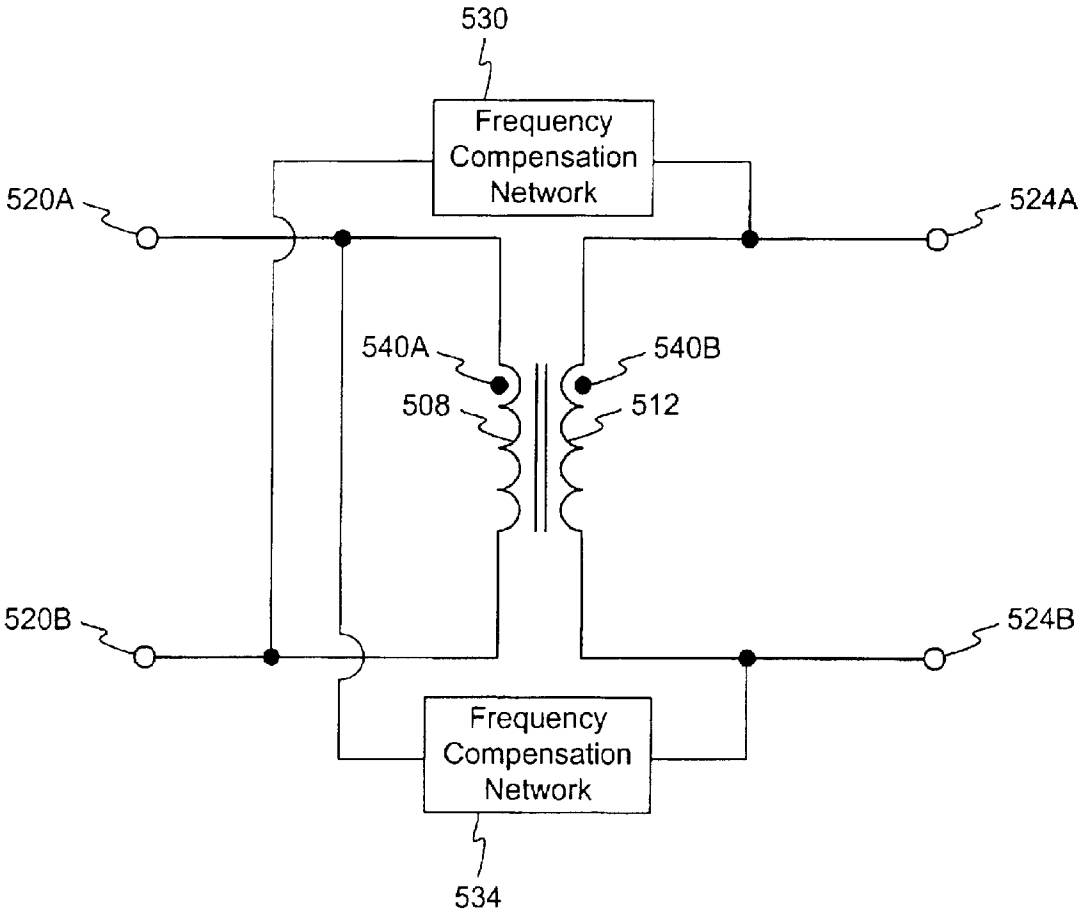
FIG. 5 illustrates an example embodiment of a transformer configured according to the principles disclosed herein.

FIG. 5 illustrates a block diagram of an example embodiment of the invention. As shown, a transformer 504 has a primary winding 508 and a secondary winding 512. The primary winding 508 has terminals 520A, 520B, while the secondary winding 512 has terminals 524A, 524B. In the example embodiment shown in FIG. 5, a first compensation network 530 connects to the primary winding terminal 520B and the secondary winding terminal 524A. Similarly, a second compensation network 534 connects to the primary winding terminal 520A and the secondary winding terminal 524B. The first compensation network 530 and the second compensation network 534 may comprise any type device, assembly, circuit, apparatus, or system configured to modify one or more of the inductance, capacitance, impedance, or the like between any of the terminals of the transformer. In one embodiment, either or both of the compensation networks 530, 534 comprise an external capacitor, or equivalent impedance fabricated by printed circuit board, thick-film hybrid, or thin-film hybrid technology, or any other type of capacitance generating, inductance generating, and/or impedance matching device, element, or system as is known now or as may be developed in the future. The compensation networks 530, 534 may comprise active elements, passive elements, or both. The compensation networks 530, 534 may be identically configured or configured differently.

The compensation networks 530, 534 may be described as cross-connected in that connections of the networks 530, 534 are connected between terminals of opposing polarity. Thus, based on the polarity shown by polarity indicators 540, a compensation network is connected between the primary winding's first terminal 520A and the secondary winding's terminal with opposing polarity, in this embodiment, the second terminal 524B. Similarly, a compensation network is connected between the primary winding's second terminal 520B and the secondary winding's terminal with opposing polarity, in this embodiment, the first terminal 524A. By way of example, the configuration shown in FIG. 7 is also cross-connected. Thus, the term cross-connected is defined to mean connected between transformer terminals of opposing polarity.

Figure 1A:
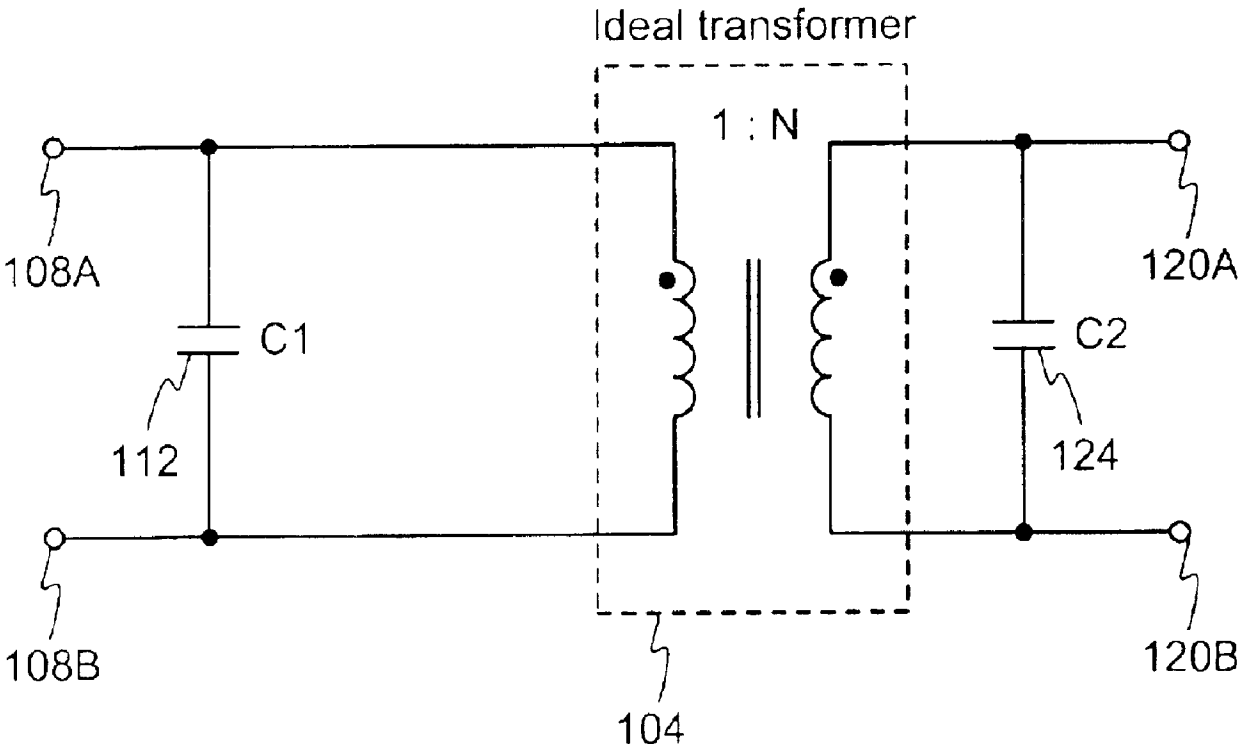
Fig. 1A Prior Art
FIG. 1A illustrates a block diagram of a prior art transformer configuration.
Figure 1B:
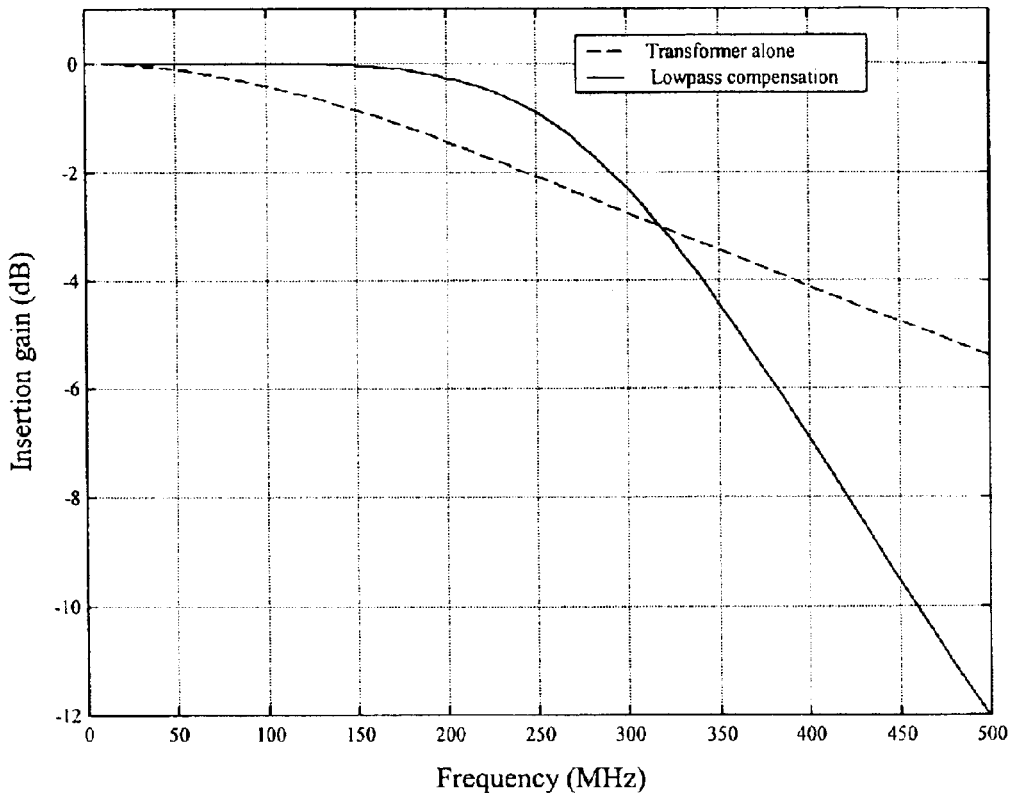
Fig. 1B Prior Art
FIG. 1B illustrates a graph of a prior art transformer performance.

The system and technique proposed herein and illustrated in FIG. 5 may be generally categorized as a compensation method. As shown, compensation components may be combined with the parasitic leakage inductance to synthesize a symmetrical lattice network with an insertion loss characteristic that closely resembles an all-pass network. The superiority of the proposed compensation method results from the capability of the all-pass network to provide, in some embodiments, relatively uniform gain over an arbitrarily large bandwidth independent of the value of the transformer leakage inductance. In contrast, the prior art methods and systems, such as that shown in FIG. 1A, are ultimately limited by the value of the transformer leakage inductance.

The compensation networks 530, 534, together with the transformer, may be embodied as an equalizer, and hence may be designed to provide low insertion loss (with some prescribed variation) across an arbitrarily large bandwidth. As a result, such structure is not subject to the inherent bandwidth limitations of the low-pass compensation method of the prior art.

Although the principles disclosed herein apply to any turn ratio, the operating principle of this technique can most easily be discussed with the special case of a 1:1 turn ratio transformer. For this case, the compensation network becomes a symmetrical lattice. Using the measured values of the leakage inductance $L_{LKG}$ and of the interwinding capacitance $C_{WW}$, and a selected value of the double-termination resistance R, in one embodiment the network will provide a second-order (constant resistance) all-pass characteristic if:

$$L_{LKG} \times C_{WW} = L_{COMP} \times C_{COMP}$$

and $$\frac{L_{LKG}}{C_{COMP}} = R^2$$

In such case, the added gain introduced by inserting the network between the terminations (insertion gain) becomes H(s), where H(s) is defined as follows and the term s is defined as complex frequency jω (ω=2πf). As a result:

$$H(s) = \frac{1 - sC_{WW}R + s^2 L_{LKG} C_{WW}}{1 + sC_{ww}R + s^2 L_{LKG} C_{ww}}$$

An ideal all-pass network has constant unity gain loss across infinite bandwidth, with no high-frequency roll-off. In reality, the compensated transformer may not have unlimited bandwidth or perfectly flat gain. However, such deviations from ideality are due to mismatches in the compensation network and to other smaller transformer parasitic components, such as interwinding capacitance, resistive losses, and the distributed nature of the leakage inductance. Imperfect matching in the compensation network will also cause some minor dips or peaks (equalizer type behavior) in the network transfer function. These deviations would exist in any transformer configuration and are unrelated to the principles of the invention. As shown and discussed above, this compensation method greatly extends the usable transformer bandwidth beyond that of the prior art, such as by the method of low-pass compensation.

Extending the method to transformers with arbitrary turn ratio N, and having properly matched termination resistors R and $N^2R$, the gain of the network at very high frequencies can be shown to converge asymptotically to:

$$H(s) \approx \frac{1 + N^2}{2N}$$

In one embodiment, the value of the turn ratio N is 1.0, which allows, in theory, for unity gain (zero loss) over infinite bandwidth. At very high frequencies, the loss may increase for any positive or negative deviations from the value of N being equal to 1. In one embodiment, the minimum insertion loss at very high frequencies is less than 2 dB if N is between 0.5 and 2.0. In practice, this is not a seriously significant amount of loss, as the loss introduced by other smaller transformer parasitic components dominate at very high frequencies. With the configuration, the usable transformer bandwidth may be extended well beyond the range achievable by compensation of the prior art. Measurements have confirmed useful bandwidth extensions (useful bandwidth defined only for purposes of discussion as loss less than 1.5 dB) greater than 300 percent for a 50 to 100 Ohm impedance matching transformer. Thus, an effective solution for extending the bandwidth of a high frequency transformer operation is achieved.

Figure 6A:
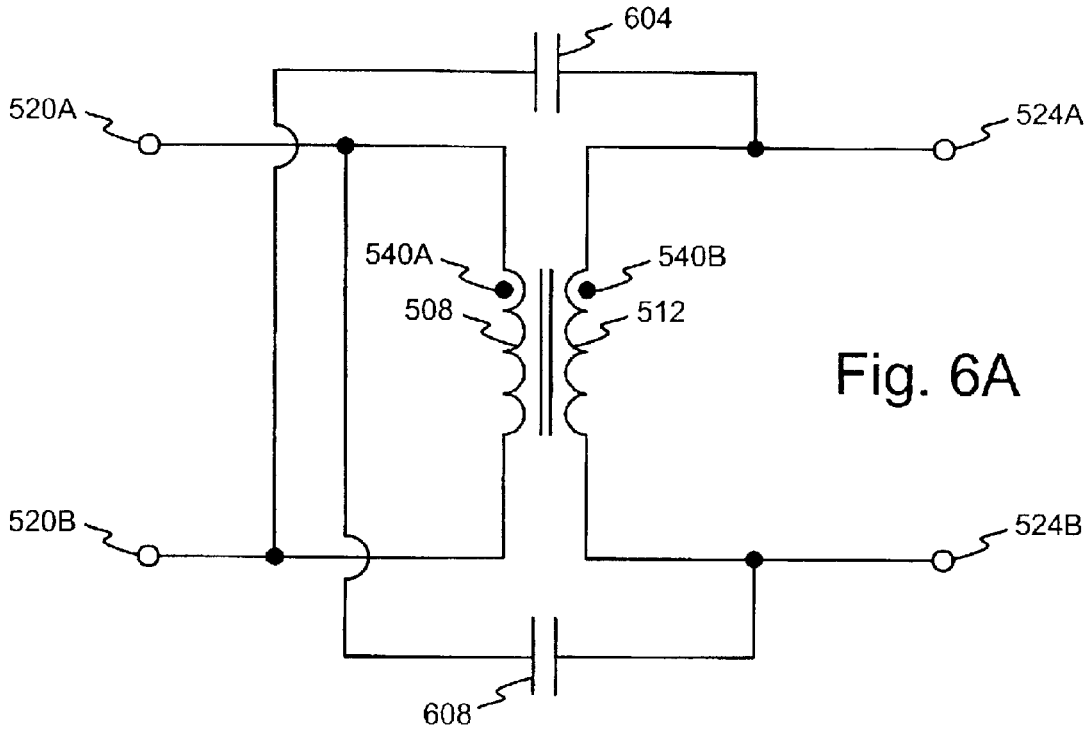
FIG. 6A illustrates an example implementation of a transformer system configured according to the principles disclosed herein.

FIG. 6A illustrates an example implementation of a transformer configured according to the principles disclosed herein. As portions of FIG. 6 are similar to FIG. 5, identical elements are identified with identical reference numerals. In this example embodiment, the first compensation network comprises a first capacitor 604 and the second compensation network comprises a second capacitor 608. In this configuration, the capacitors are cross-coupled across the windings to create a high frequency network.

Figure 6B:
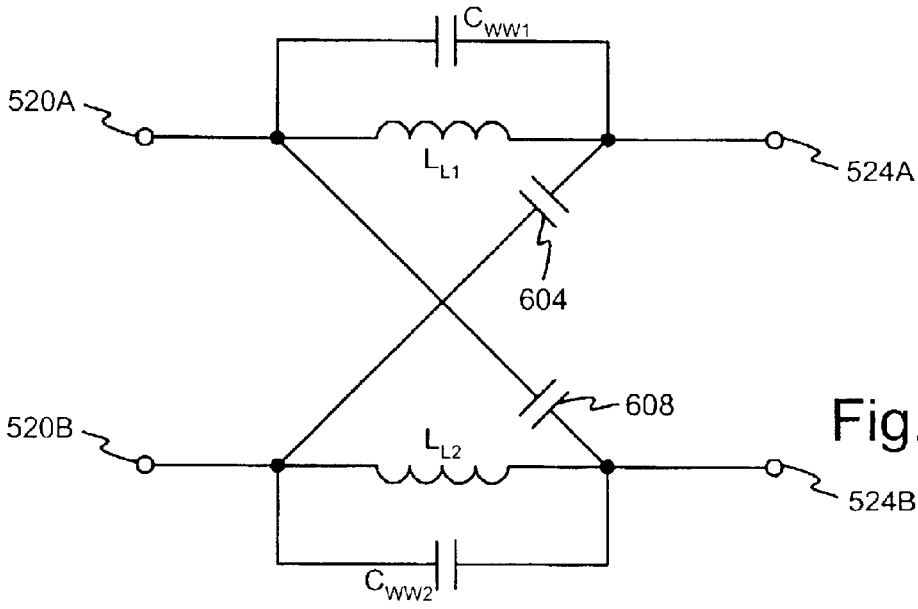
FIG. 6B illustrates an equivalent model of the example embodiment shown in FIG. 6A.

FIG. 6B illustrates an equivalent model of the example embodiment shown in FIG. 6A. In this equivalent circuit, a capacitor $C_{WW1}$, which represents the interwinding capacitance, connects between terminal 520A and terminal 524A. Likewise, a capacitor $C_{WW2}$, which represents the interwinding capacitance, connects between terminal 520B and terminal 524B. Leakage inductances $L_{L1}$, $L_{L2}$ are represented between terminals 520A and 520B and terminals 524A, 524B as shown. To account for these capacitances and parasitic inductances, compensation capacitors 604, 608 are added to allow for high frequency operation. Because of the compensation capacitors 604, 608, the system is not subject to the bandwidth limitations of the prior art systems.

It is contemplated that the capacitance values may assume any value and may be arrived at by calculation or experimentation. The values, types, effect and nature of the compensation, such as compensation capacitors 604, 608, is dependent upon the type and configuration of the transformer. One of ordinary skill in the art will be able to determine appropriate capacitance values to add to the transformer based on desired bandwidth specifications.

Figure 7A:
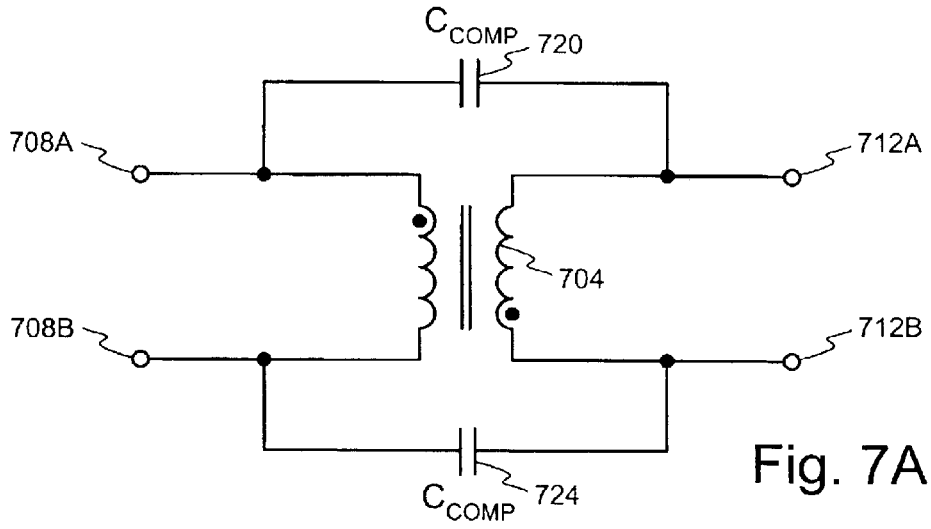
FIG. 7A illustrates an example implementation of a transformer system configured according to the principles disclosed herein.

FIG. 7A shows another example implementation of the invention. As shown, transformer 704 is connected in a reverse winding polarity configuration. A first compensation capacitor 720 is connected between terminal 708A and terminal 712A. A second compensation capacitor 724 is connected between terminals 708B and 712B. One advantage to this configuration is the simplified interconnection geometry realized by utilization of the reverse polarity transformer configuration. In this configuration, there are no crossed conductors as a result of the addition of the external components. One benefit of eliminating the cross conductors when adding capacitors 720, 724 or other compensation devices is a reduction in the length of the conductor that connects the capacitors to the transformer terminals. As a result of the shorter conductor length, less inductance is added to the system, which in turn may result in better performance.

Figure 7B:
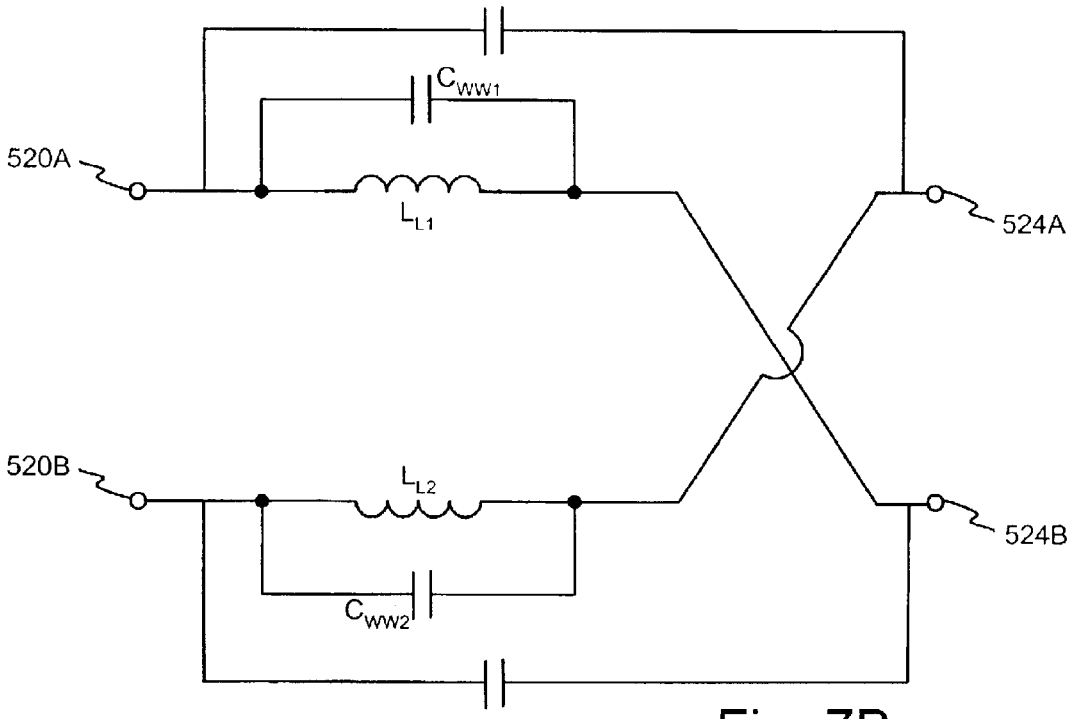
FIG. 7B illustrates an equivalent model of the example embodiment shown in FIG. 7A.

FIG. 7B illustrates an equivalent model of the example embodiment shown in FIG. 7A. As shown, the compensation capacitors 720, 724 connect to opposing terminals of the transformer.

Figure 7C:
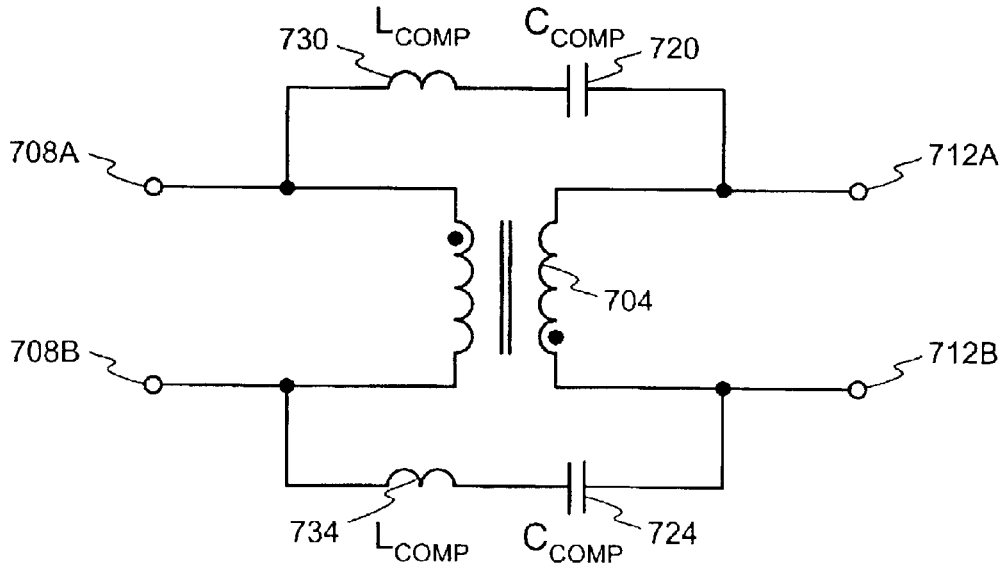
FIG. 7C illustrates an example implementation of a transformer system with compensation capacitors and compensation inductors.

FIG. 7C illustrates the example embodiment shown in FIG. 7A, with adds an inductance element 730, 734 in series with the compensation capacitors 720, 724. The inductance may be added in the form of inductors 730, 734, or any other device or element, to establish the desired pass band in the compensation network. As shown, the first compensation inductor 730 is connected in series with the compensation capacitor 720, while the second compensation inductor 734 is connected in series with the compensation capacitor 724. The inductances correspond to inductors 730, 734 that are placed in the system in addition to the inductances generated by the leads of the capacitors and those that are part of the transformer model.

Based upon laboratory measurements of one example implementation, the method and apparatus described herein extend the useful transformer bandwidth to beyond 400 MHz using compensation capacitors in the range of 1.5 to 6.0 pF. When the required capacitance values are small, such as less than 1 pF, the compensation capacitors can be realized in one embodiment in a cost-effective manner within the mounting substrate. The compensation capacitors may be comprised of any type capacitor or capacitance generating element or device including, but not limited to, printed circuit board, thick-film hybrid, or thin-film hybrid technologies, or external capacitor. Because of the relatively large thickness of the insulation layers, substrate fabrication provides the additional advantage of high voltage isolation. This isolation may be important because many data communication applications must withstand up to or greater than 1500 Volts (without insulation breakdown) across the line transformer interface (which would include compensation capacitors) to meet required safety standards. It should be noted that this is one example embodiment and the claims that follow are not limited to the laboratory example.

The following is an example of printed circuit fabrication for a compensation capacitor. The standard formula for a parallel plate capacitor is:

$$C = \frac{\varepsilon_0 \varepsilon_r A}{d}$$

here C is the capacitance in Farads, $\epsilon_0$ is the permittivity of free space, $\epsilon_r$ is the relative permittivity, A is the plate surface area (in meters$^2$) and d is the plate separation distance (in meters).

A typical exemplary multi-layer printed circuit board is constructed with 5 mils (0.127 mm) of dielectric insulation between layers. A commonly used dielectric is a flame retardant fiberglass, known as FR4, which has a relative permittivity (or dielectric constant) of 4.3. To fabricate a 2 pF capacitance in this substrate can require a plate (board) surface area A of 6.67 mm$^2$, which is approximately a 0.1 inch wide square.

In one embodiment, the required value of inductance is selected to be small, and as a result, the interconnecting PCB trace may be used to realize the added inductance shown in FIG. 7C. In one embodiment, the value of added inductance and capacitance depends upon $C_{ww}$. In practice, it may not be possible, or it may be undesirable, to make $L_{COMP}$ zero. As a result and for certain applications, specifically unbalanced-to-unbalanced coupling, the embodiment shown in FIG. 7A may cause the transformer interwinding capacitance to act as part of the required compensation capacitance, reducing the value of the required external capacitors. Since the required capacitance values are small, possibly less than 10 pF, the compensation capacitors can be realized in a cost-effective manner within the mounting substrate. The compensation capacitors may be comprised of any type capacitor or capacitance generating element of device including, but not limited to, printed circuit-board, thick-film hybrid, or thin-film hybrid technologies, or external capacitors.

Figure 8:
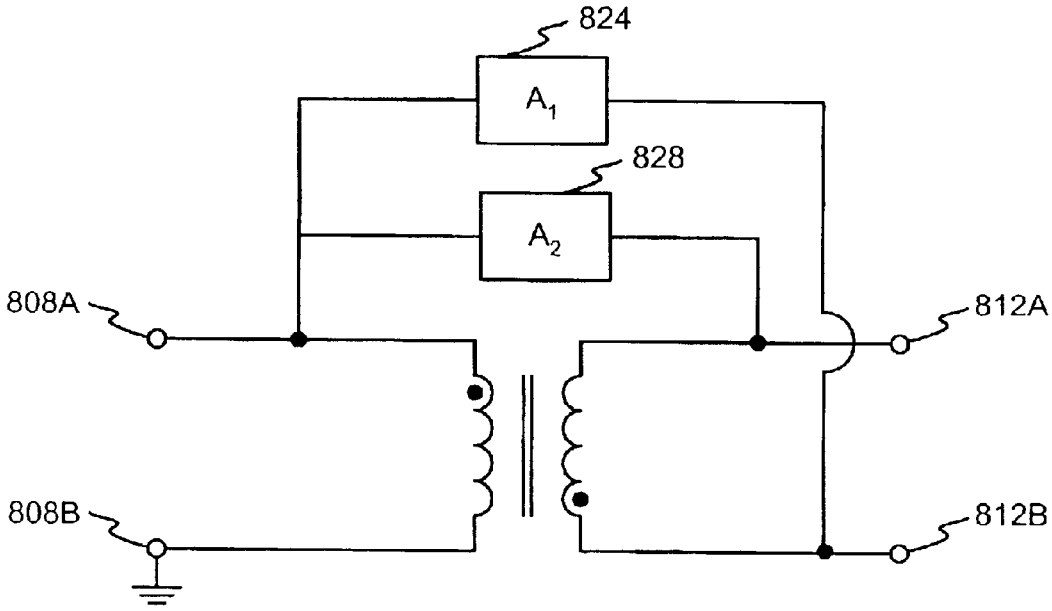
FIG. 8 illustrates an example embodiment of a transformer system in an unbalanced configuration with a compensation network.

FIG. 8 illustrates a block diagram of an example embodiment of a transformer in an unbalanced configuration with a compensation network. As shown, transformer terminals 808A, 808B, 812A, 812B connect to a transformer 820. The terminal 808B is grounded as shown to create an unbalanced configuration. In this exemplary configuration, compensation networks 824 and 828 connect between terminals 808A, 808B, 812A, 812B as shown. The compensation networks may comprise one or more capacitors, one or more inductors, one or more active devices, or any combination of the above devices. Note that both of the compensation networks connect to the ungrounded terminal 808A, yet also connect to different terminals 812A, 812B.

In various other embodiments, it is contemplated that the principles described herein may be adopted for use with transformers configured for operation in any frequency band. It is contemplated that the frequency may range from DC to into the multi-gigahertz range. Thus, the principles will also apply to low frequency environments to reduce insertion loss. It may, however, be necessary to modify the capacitance and/or inductance values, depending on the particular application and frequency bandwidth. It is contemplated that, through basic modeling and without undue experimentation, the capacitance and/or inductance values may be arrived at by one of ordinary skill in the art. Similar transformers configured other than as shown may also be utilized. Thus, center tap or multi-tap configurations are contemplated for use with the principles described herein.

While various embodiments of the invention have been described, it will be apparent to those of ordinary skill in the art that many more embodiments and implementations are possible that are within the scope of this invention.

What is claimed is:

1. A system for increasing the bandwidth of a transformer, the transformer having a primary winding having a first primary winding terminal and a second primary winding terminal and a secondary winding having a first secondary winding terminal and a second secondary winding terminal, the system comprising:

a first capacitor connected between the first primary winding terminal and the second secondary winding terminal; and a second capacitor connected between the second primary winding terminal and the first secondary winding terminal;

wherein the first primary winding terminal is of a different polarity than the second secondary winding terminal and the capacitance of the first capacitor and the second capacitor is selected to increase the bandwidth of the transformer.

2. The system of claim 1, wherein the transformer is in a balanced configuration.

3. The system of claim 1, wherein either or both of the first capacitor and the second capacitor comprise capacitors selected from the group of capacitors consisting of printed circuit board capacitors, thick-film hybrid capacitors, or thin-film hybrid capacitors.

4. The system of claim 1, wherein the first and second terminals of the primary winding connect to a communication device and the first and second terminals of the secondary winding connect to a communication channel.

5. The system of claim 1, wherein the bandwidth of the transformer is greater than 200 MHz.

6. A high frequency transformer system comprising:

a first winding defined by a first conductor having a first end and a second end;

a second winding proximately arranged to the first winding, the second winding defined by a second conductor having a third end and a fourth end, a first compensation device cross-connected between the first winding and the second winding; and a second compensation device cross-connected between the first winding and the second winding, wherein the first compensation device and the second compensation device are connected to different ends of the windings.

7. The transformer system of claim 6, wherein the first compensation device and the second compensation device comprise capacitors.

8. The transformer system of claim 6, wherein proximately arranged comprises sufficiently close to establish magnetic and electric field coupling.

9. The transformer system of claim 6, wherein cross-connected comprises connected between ends of a transformer that are of different polarity.

10. The transformer system of claim 6, further comprising one or more inductive devices connected to one or more ends and configured to tune the transformer to one or more frequency bandwidths.

11. The transformer system of claim 6, wherein the high frequency transformer has a bandwidth of between 200 MHz and 450 MHz.

* * * * *